US010959516B2

(12) United States Patent
Cheng

(10) Patent No.: US 10,959,516 B2
(45) Date of Patent: Mar. 30, 2021

(54) RACK EASY TO ASSEMBLE AND DISASSEMBLE

(71) Applicant: GUANGDONG WIREKING COMMERCIAL CO., LTD., Guangdong (CN)

(72) Inventor: Chunxuan Cheng, Guangdong (CN)

(73) Assignee: GUANGDONG WIREKING COMMERCIAL CO., LTD., Guangdong (CN)

( * ) Notice: Subject to any disclaimer, the term of this patent is extended or adjusted under 35 U.S.C. 154(b) by 0 days.

(21) Appl. No.: 16/734,347

(22) Filed: Jan. 5, 2020

(65) Prior Publication Data

US 2020/0214443 A1 Jul. 9, 2020

(30) Foreign Application Priority Data

Jan. 4, 2019 (CN) ..... 201920022491.8

(51) Int. Cl.
*A47B 47/02* (2006.01)
*A47B 45/00* (2006.01)
(Continued)

(52) U.S. Cl.
CPC ..... *A47B 47/021* (2013.01); *A47B 45/00* (2013.01); *A47B 47/00* (2013.01); *A47B 57/00* (2013.01); *A47B 57/06* (2013.01); *A47F 5/01* (2013.01)

(58) Field of Classification Search
CPC ..... A47B 31/00; A47B 2031/002; A47B 2031/004; A47B 2031/008; A47B 47/021; A47B 57/06; A47B 57/12; A47B 57/14; A47B 57/36; A47B 57/38; A47B 57/30; A47B 57/40; A47B 47/024; A47B 47/025; A47B 45/00; A47B 47/00; A47B 57/00; B62B 2205/32; B62B 3/006; A47F 5/137; A47F 5/01
(Continued)

(56) References Cited

U.S. PATENT DOCUMENTS 1,456,446 A * 5/1923 Hotaling ..... A47F 7/148 211/50
2,319,237 A * 5/1943 Kautz ..... A47B 57/06 248/235
(Continued)

*Primary Examiner* — Jonathan Liu
*Assistant Examiner* — Devin K Barnett

(57) ABSTRACT

Provided is a rack easy to assemble and disassemble, comprising a front frame, a rear frame, and a number of shelves arranged between the front frame and the rear frame for placing articles thereon, wherein a number of supporting members for supporting the shelves are symmetrically distributed on the front frame and the rear frame, and the width of the shelves is slightly greater than that of the front frame and the rear frame. Compared with the prior art, the supporting members of the present invention for supporting the shelves are symmetrically distributed on the front frame and the rear frame, such that the shelves are directly placed on the supports on the front frame and the rear frame when in use, and the shelves can be removed from the supporting frames when the rack needs to be stored. The rack has a good bearing capacity, is easy to disassemble, assemble and use, and has a small package size after disassembly and is therefore convenient for storage.

20 Claims, 9 Drawing Sheets

(51) Int. Cl.
*A47F 5/01* (2006.01)
*A47B 47/00* (2006.01)
*A47B 57/00* (2006.01)
*A47B 57/06* (2006.01)

(58) Field of Classification Search
USPC ..... 211/187, 186
See application file for complete search history.

(56) References Cited

U.S. PATENT DOCUMENTS

D180,883 S * 8/1957 Perry ..... D7/704
2,886,186 A * 5/1959 Hamilton ..... A47B 31/00 108/189
3,252,434 A * 5/1966 Young, Jr. ..... A47F 5/13 108/181
3,280,989 A * 10/1966 Melvin ..... A47F 5/01 211/133.2
3,316,864 A * 5/1967 Maslow ..... A47B 57/54 108/148
3,435,958 A * 4/1969 Chesley ..... A47F 5/13 211/133.2
3,536,016 A * 10/1970 Chesley ..... A47B 87/0215 108/181
3,884,358 A * 5/1975 Marschak ..... A47B 57/14 211/186
3,977,529 A * 8/1976 Stroh ..... A47F 5/135 211/187
4,004,819 A * 1/1977 Brongo ..... B62B 3/006 280/79.3
4,298,127 A * 11/1981 Upshaw ..... B65D 21/06 206/513
4,754,885 A * 7/1988 Rich ..... A47F 5/132 211/132.1
5,065,873 A * 11/1991 Tseng ..... A47B 57/54 211/187
5,251,973 A * 10/1993 Hazan ..... A47B 61/00 211/186
5,326,062 A * 7/1994 Remmers ..... A47B 55/02 211/106
5,718,441 A * 2/1998 Kern ..... A47B 57/14 211/187
6,173,847 B1 * 1/2001 Zellner, III ..... A47B 55/02 211/186
6,497,331 B1 * 12/2002 Morandi ..... A47B 43/00 211/149
8,267,261 B2 * 9/2012 Vanderhoek ..... A01G 9/143 211/150
8,739,986 B2 * 6/2014 Preidt ..... A47F 5/00 211/188
9,004,300 B1 * 4/2015 Morrell ..... A47B 57/20 211/187
9,247,834 B1 * 2/2016 Lucht ..... A47B 47/0083
10,252,737 B2 * 4/2019 Nowe ..... A47B 57/16
2002/0130098 A1 * 9/2002 Simard ..... A47F 5/01 211/181.1
2003/0106473 A1 * 6/2003 Welch ..... F24C 15/16 108/109
2004/0089625 A1 * 5/2004 Tsai ..... A47B 88/402 211/126.2
2004/0251226 A1 * 12/2004 Yang ..... A47C 19/021 211/187
2008/0203042 A1 * 8/2008 Felsenthal ..... A47B 47/027 211/153
2009/0152225 A1 * 6/2009 Lee ..... A47B 87/008 211/187
2010/0288717 A1 * 11/2010 Morandi ..... A47B 43/00 211/187
2011/0220603 A1 * 9/2011 Morandi ..... A47B 47/024 211/186
2015/0069000 A1 * 3/2015 Rosen ..... A47B 47/0058 211/186
2015/0096953 A1 * 4/2015 Lai ..... A47B 47/024 211/186
2015/0327678 A1 * 11/2015 Tang ..... A47B 88/04 312/334.44
2016/0235197 A1 * 8/2016 Kabacinski ..... B62B 3/005
2017/0057531 A1 * 3/2017 Nowe ..... B62B 3/005
2019/0133413 A1 * 5/2019 Maslana ..... A47L 19/04

* cited by examiner

RACK EASY TO ASSEMBLE AND DISASSEMBLE

TECHNICAL FIELD

The present invention relates to a multi-tier rack for placing goods, and more particularly to a rack easy to assemble and disassemble.

BACKGROUND ART

During handling of goods, providing a rack with a plurality of shelves can not only place more goods, but also reduce the floor space. However, the rack takes up a lot of room when empty, making it inconvenient to store. In order to facilitate the storage of the rack, a combined rack has appeared in the market, and when the rack is empty, the various components of the rack can be disassembled and stored. In this way, although the rack which can be disassembled for storage is easy to store, it is troublesome to assemble when required for use.

SUMMARY OF THE INVENTION

An object of the present invention is to provide a rack easy to assemble and disassemble in order to solve the problems existing in the prior art.

In order to achieve the above object, the technical solution employed by the present invention is as follows: a rack easy to assemble and disassemble, comprising a front frame, a rear frame, and at least one tier of shelf arranged between the front frame and the rear frame for placing articles thereon, a number of supporting members for supporting the shelves symmetrically distributed on the front frame and the rear frame, said shelves being hung on the supporting members and fixing the front frame to the rear frame.

Each of the supporting members comprises a horizontal element horizontally arranged on the sides of the front frame and the rear frame facing each other, a pair of extension elements arranged on the sides of two supporting columns constituting the front frame or the rear frame that face each other and below the horizontal element, a pair of connection elements respectively connected to two ends of the horizontal element at one end, respectively connected to extension elements at the other end, wherein the width of the horizontal element is adapted to the width of the shelves, and the distance from the extension elements to the horizontal element is adapted to the height of the shelves.

Each of the shelves comprises a number of transversely arranged U-shape elements and a number of longitudinally arranged longitudinal elements which connects all the U-shape elements together.

Junctions between the connection element and the horizontal element are engaged with junctions between the outermost U-shape element at two ends of the shelf and the outermost longitudinal element; and two ends of the bottom of each of the outermost U-shape elements are engaged with junctions between the connection elements and the extension elements.

The width of the shelves is slightly greater than that of the front frame and the rear frame.

As an improvement, a first arc connection element is provided at the junction between the connection element and the horizontal element, said first arc connection elements being disposed at the junctions between the outermost U-shape elements at the two ends of the shelf and the outermost longitudinal element, and upper ends of each of the outermost U-shape elements being located on the inner sides of the first arc connection element. The first arc connection elements are arc-shaped and have an arc adapted to the contour of the outermost U-shape elements.

A second connection element is provided at the junction between the connection element and the extension element, two ends of the bottom of each of the outermost U-shape elements being disposed on the inner sides of said second connection elements. The second connection elements are arc-shaped and have an arc adapted to the contour of the outermost U-shape elements.

As another improvement, the front frame and the rear frame are respectively formed by connecting an upper part and a lower part, the lower part is provided with a joining portion, the outer diameter of the joining portion is adapted to the inner diameter of the upper part at a lower end thereof, the joining portion is provided with a pop-out pin, the lower end of the upper part is provided with a positioning hole adapted to the pop-out pin, and when the upper part is connected to the lower part, the joining portion extends into the lower end of the upper part, and the pop-out pin protrudes from the positioning hole.

As another improvement, the rack easy to assemble and disassemble further comprises at least one hook assembly hooked to the shelf, wherein the hook assembly comprises a supporting wire, and a number of hooks uniformly distributed on the supporting wire, said hooks comprising first hooks and second hooks arranged at intervals, said first hooks and said second hooks fixed onto the supporting wire; a first connecting wire, a second connecting wire and a third connecting wire parallel to each other extending rearward from the tail of each of the first hooks, the first connecting wire and the third connecting wire located above the second connecting wire, the altitude difference from the first connecting wire and the third connecting wire to the second connecting wire adapted to the diameter of the longitudinal elements, the second connecting wire extending rearward from an end of the first connecting wire and having a length adapted to the distance between two adjacent longitudinal elements, the third connecting wire extending toward the first connecting wire from an end of the second connecting wire and having a length less than the length of the second connecting wire, the junction between the first connecting wire and the second connecting wire placed on the outermost longitudinal element at the bottom of the shelf, and the junction between the second connecting wire and the third connecting wire placed on the longitudinal element adjacent to said outermost longitudinal element at the bottom of the shelf.

A third arc connection element is provided at the junction between the first connecting wire and the second connecting wire, a fourth arc connection element is provided at a position where the second connecting wire is linked to the third connecting wire, and each of the third arc connection element and the fourth connection element has an arc adapted to the contour of the longitudinal elements.

Sleeves are provided on the same side of the front frame and the rear frame, the length of the supporting wire is adapted to the distance between the two sleeves, and vertical extensions with axes adapted to the sleeves downwardly extend from two ends of the supporting wire; and when the hook assembly is connected to the shelf, the vertical extensions at the two ends of the supporting wire extend into the sleeves.

The bottom of the U-shape element of at least one shelf protrudes upwardly to form a blocking edge, the blocking edge having a height greater than that of the horizontal element of the support.

As another improvement, the rack easy to assemble and disassemble further comprises at least one bag for placing articles therein, the bag being arranged inside the shelf and close to the front frame or the rear frame. The bag is removably connected to the shelf. The rack easy to assemble and disassemble according to claim 16, wherein a channel for the bag to pass therethrough is provided inside the shelf, at least two hooks being arranged at intervals on two sides of the channel, and the hooks being used for hooking the bag.

As another improvement, the front frame and the rear frame are respectively formed by connecting an upper part and a lower part in a rotatable manner. The upper part has a circular opening, the lower part has a rectangular opening, the opening of the upper part is connected to the opening of the lower part via a rotary connection portion such that the upper part is able to rotate relative to the lower part. The rack easy to assemble and disassemble further comprises a tableware cage for placing tableware therein and a knife rest for placing a knife therein, the tableware cage and the knife rest being respectively hung on two sides of the front frame and the rear frame.

Compared with the prior art, the present invention has the following advantages.

1. According to the rack easy to assemble and disassemble of the present invention, the supporting members for supporting the shelves are symmetrically distributed on the front frame and the rear frame, such that the shelves are directly placed on the supporting members on the front frame and the rear frame when in use, and can be removed from the frames when the rack needs to be stored. The rack has a good bearing capacity, is easy to disassemble, assemble and use, and has a small package size after disassembly and is therefore convenient for storage.

2. The junctions between the connection elements and the horizontal element can allow the shelves to be hung thereto while limiting the left and right movement, the junctions between the connection elements and the extension elements of the front frame and the rear frame can support the shelves while limiting the up and down movement of the shelf, thereby achieving easy disassembly and assembly, and the connection between the shelves and the front frame as well as the rear frame is firm.

3. A number of supporting members for supporting the shelves are symmetrically distributed on the front frame and the rear frame, and the distance between the front frame and the rear frame can be adjusted according to the length of the shelves, thereby obtaining a wide range of applications and a strong versatility.

Figure 1:
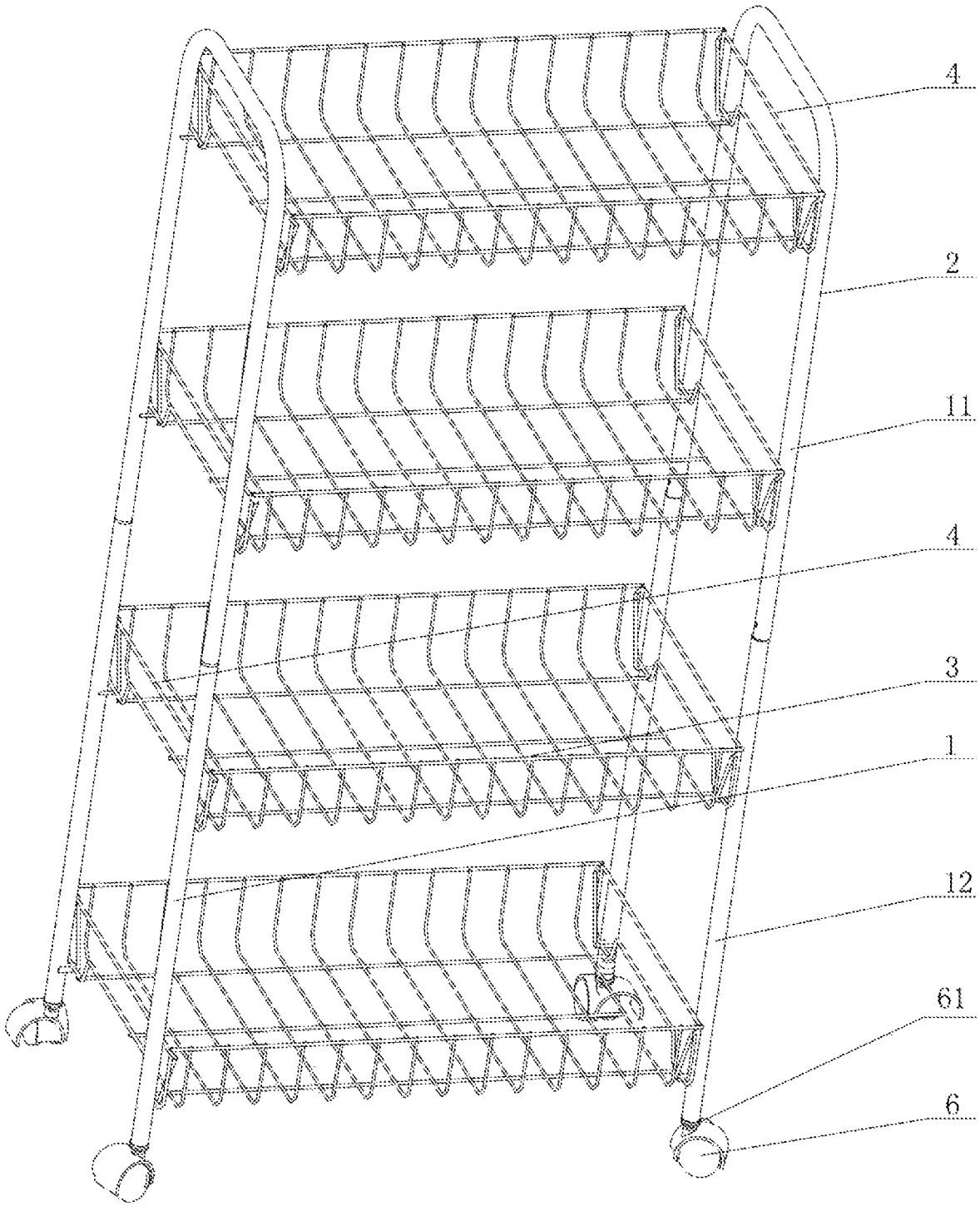
FIG. 1 is a schematic structural view of a rack easy to assemble and disassemble of the present invention.
Figure 2:
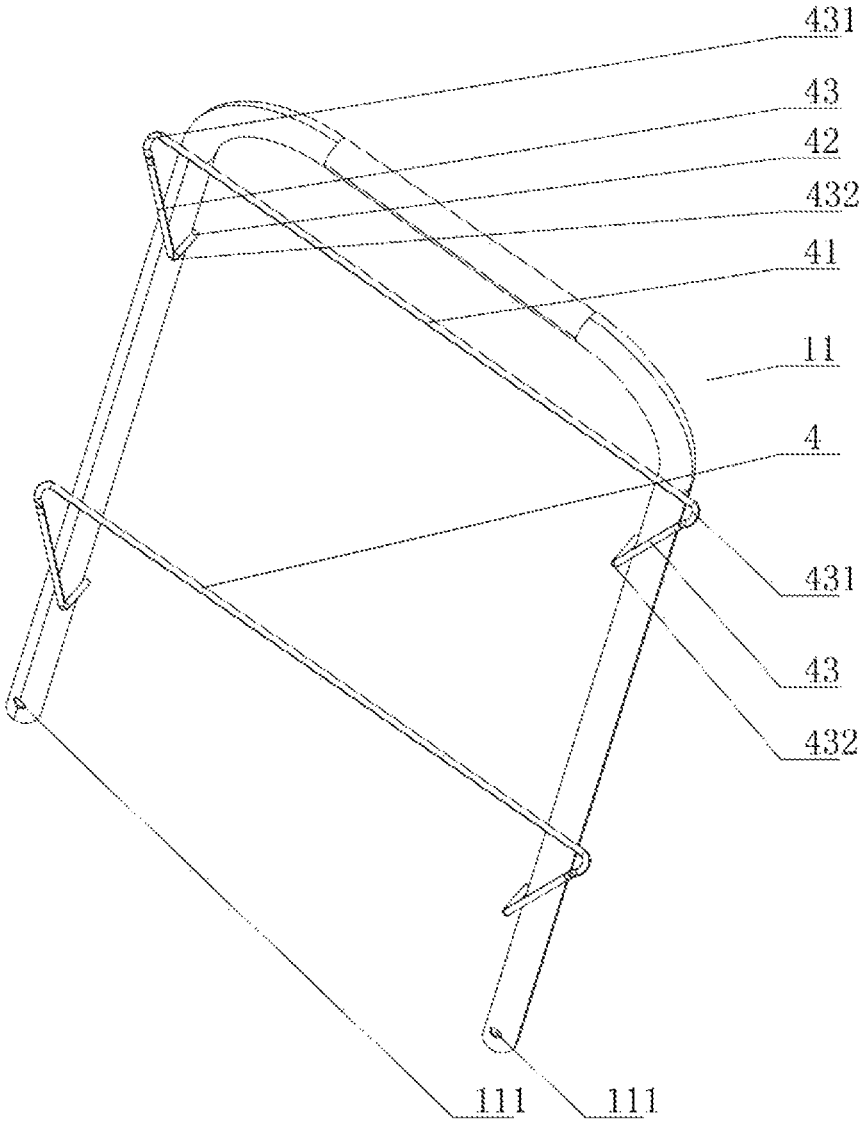
FIG. 2 is a schematic structural view of an upper part of a front frame or a rear frame in FIG. 1.
Figure 3:
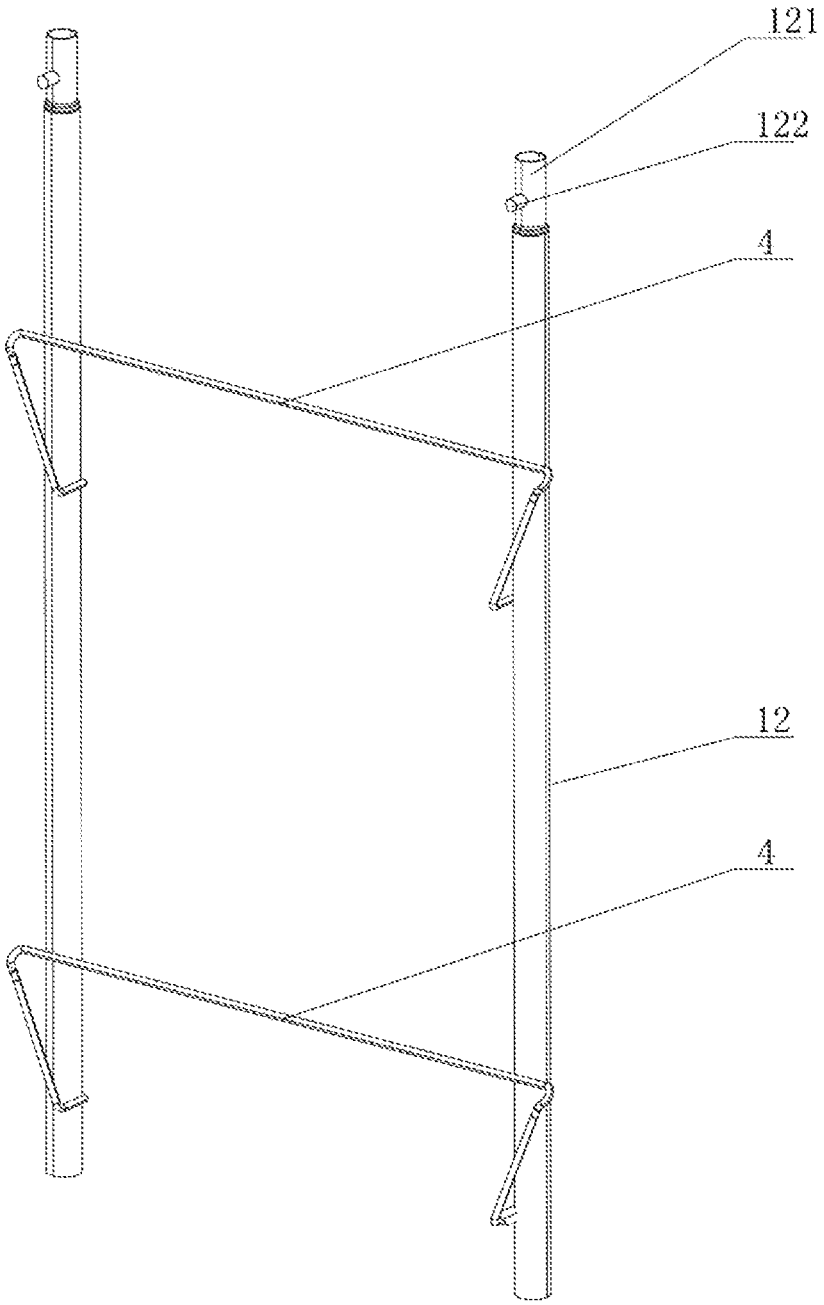
FIG. 3 is a schematic structural view of a lower part of the front frame or the rear frame in FIG. 1.
Figure 4:
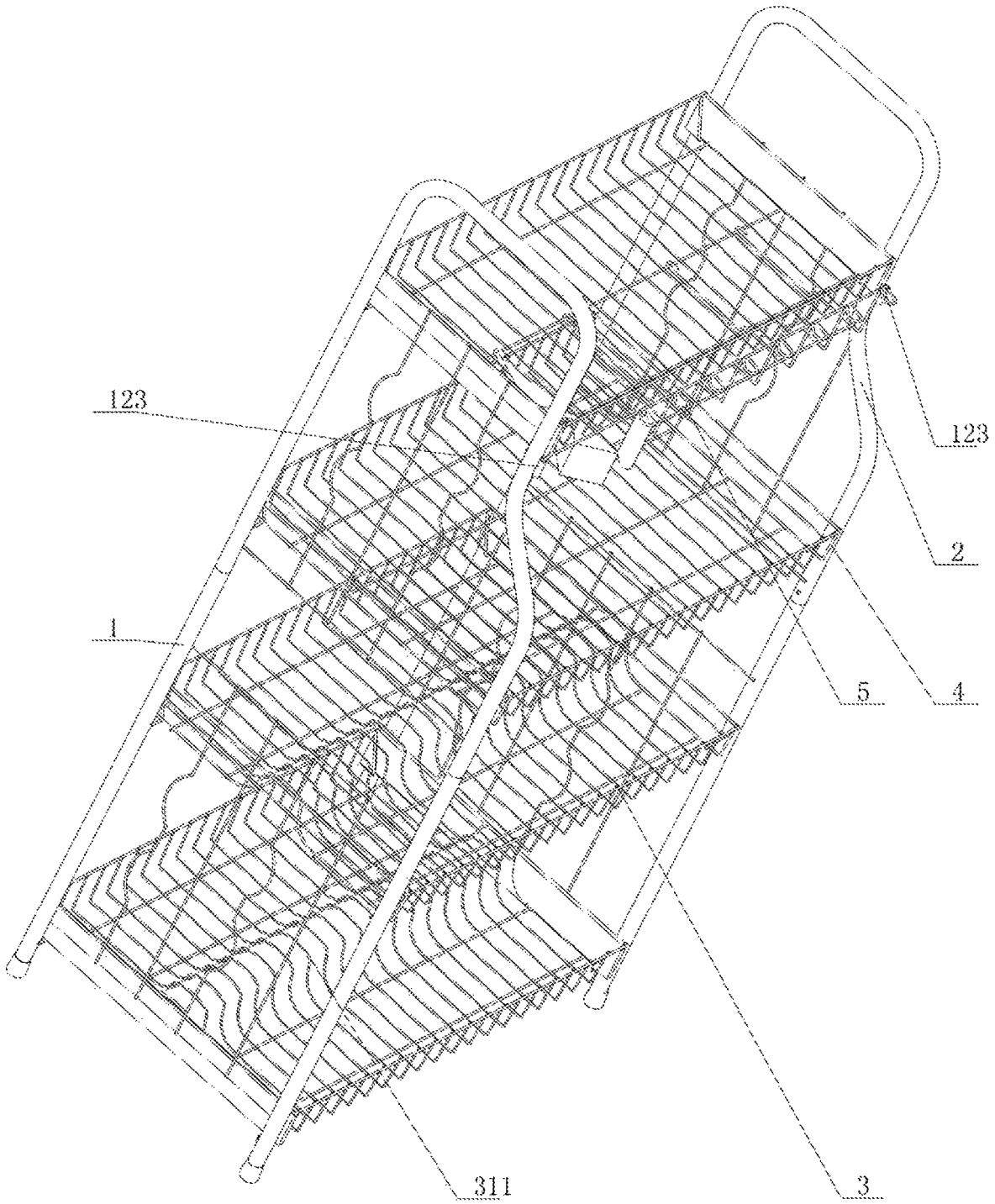
FIG. 4 is a schematic structural view of the rack easy to assemble and disassemble, which is provided with a hook assembly.
Figure 5:
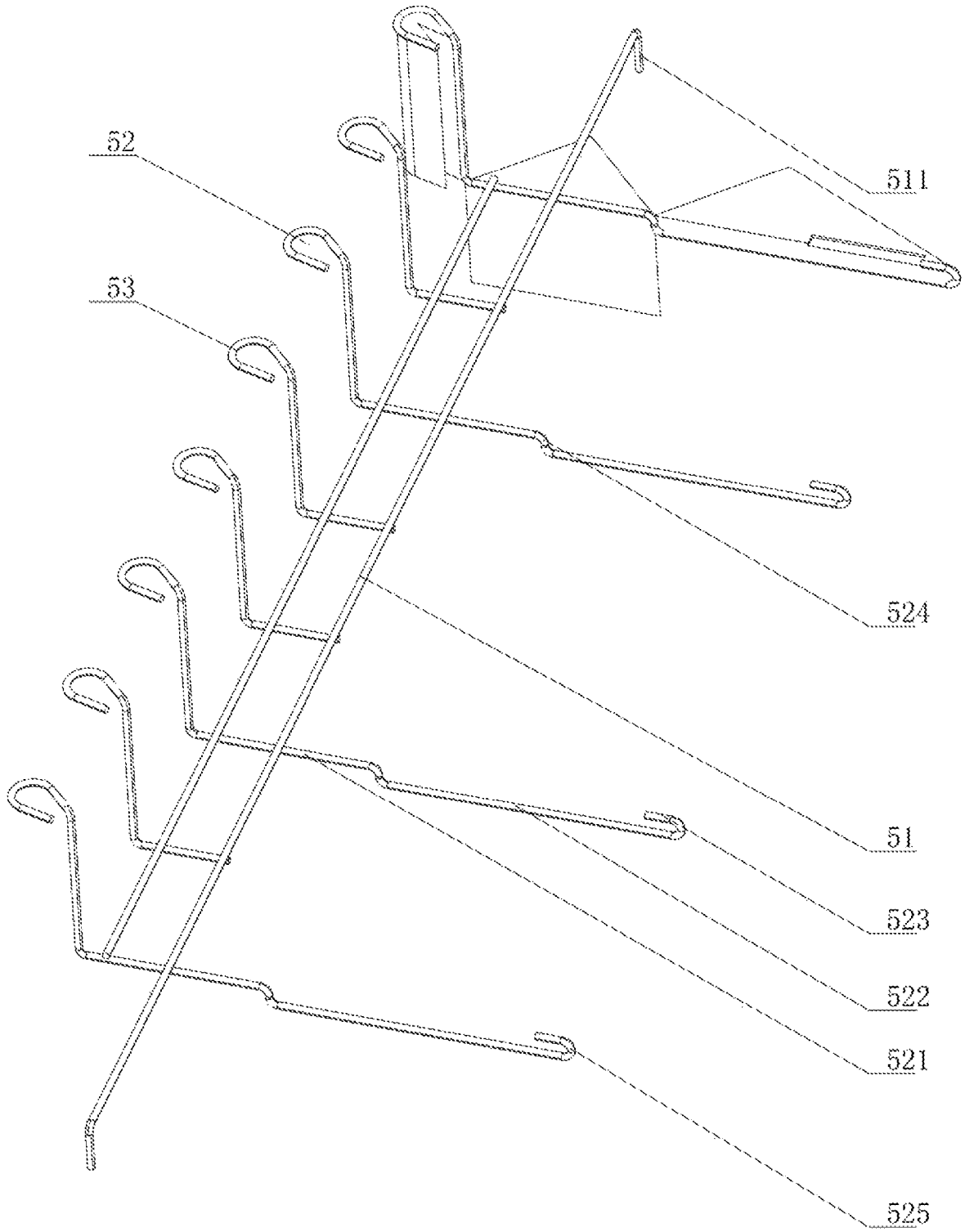
FIG. 5 is a schematic structural view of the hook assembly in FIG. 4.
Figure 6:
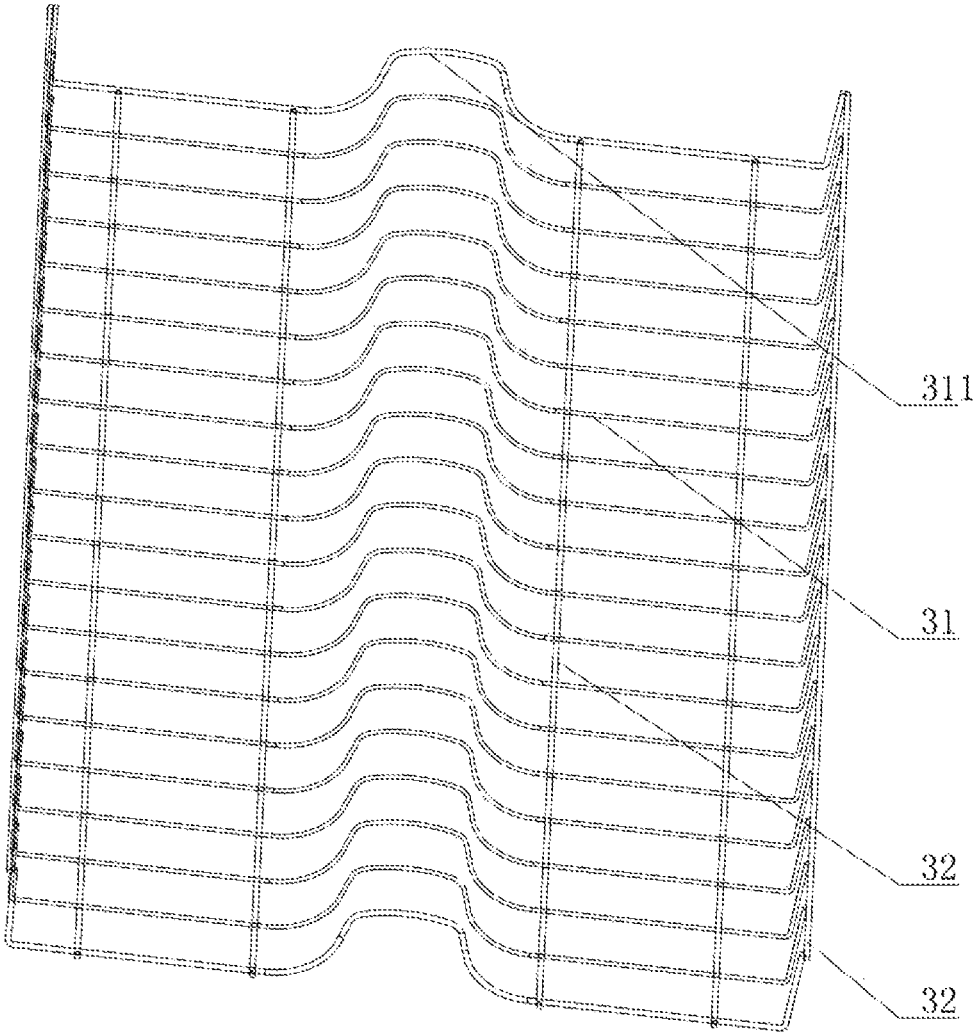
FIG. 6 is a schematic structural view of a shelf with a blocking edge in FIG. 4.

In the figures: 1. Front frame, 11. Upper part, 111. Positioninghole, 12. Lower part, 121. Joining portion, 122. Pop-out pin, 123. Sleeve, 13. Tableware cage, 14. Knife rest, 15. Draining rack, 2. Rear frame, 3. Shelf, 31. U-shape element, 311. Blocking edge, 32. Longitudinal element, 321. Hook, 4. Supporting member, 41. Horizontal element, 42. Extension element, 43. Connection element, 431. First arc connection element, 432. Second arc connection element, 5. Hook assembly, 51. Supporting wire, 511. Vertical extension, 52. First hook, 521. First connecting wire, 522. Second connecting wire, 523. Third connecting wire, 524. Third arc connection element, 525. Fourth arc connection element, 53. Second hook, 6. Caster, 61. Foot plug, 7. Bag, 8. Top shelf, 81. Channel, 9. Intermediate shelf, 10. Rotary connection portion.

DETAILED DESCRIPTION OF EMBODIMENTS

The present invention will now be further described with reference to the drawings and preferred embodiments.

First Embodiment

As shown in FIGS. 1 to 5, a rack easy to assemble and disassemble comprises a front frame 1, a rear frame 2, and a number of shelves 3 arranged between the front frame 1 and the rear frame 2 for placing articles thereon. A number of supporting members 4 for supporting the shelves 3 are symmetrically and uniformly distributed on the front frame 1 and the rear frame 2, and the shelves 3 are hung to the supporting members 4 and fix the front frame 1 to the rear frame 2 so as to make the rack more stable and reduce the lateral shaking thereof. The width of the shelves 3 is slightly greater than that of the front frame 1 and the rear frame 2. Each of the supporting members 4 comprises a horizontal element 41, extension elements 42 and connection elements 43. The extension elements 42 are respectively arranged at one end of the connection elements 43 and extend inwardly in the longitudinal direction to the frames. The both ends of the horizontal element 41 are connected to the other end of the connection elements 43. The connection elements 43 extend downwardly from the connection points so that the extension elements 42 are located below the horizontal element 41. The horizontal element 41 and the extension elements 42 are connected to the front frame 1 and the rear frame 2 by welding. The horizontal elements 41 are arranged on the sides of the front frame 1 and the rear frame 2 facing each other. The extension elements 42 are arranged on the sides of two supporting columns constituting the front frame 1 or the rear frame 2 that face each other. The width of the horizontal element 41 is adapted to the width of the shelves 3, and the distance from the extension elements 42 to the horizontal element 41 is adapted to the height of the shelves 3. Each of the shelves 3 comprises a number of transversely arranged U-shape elements 31 and a number of longitudinally arranged longitudinal elements 32 which connect all the U-shape elements 31 together. Junctions between the connection elements 43 and the horizontal element 41 are engaged with junctions between the outermost U-shape elements 31 at two ends of the shelves 3 and the outermost longitudinal element 32. Two ends of the bottom of each of the outermost U-shape elements 31 are engaged with junctions between the connection elements 43 and the extension elements 42.

Preferably, first arc connection elements 431 are provided at the junctions between the connection elements 43 and the horizontal element 41. The first arc connection elements 431 are arc-shaped and have an arc adapted to the contour of the outermost U-shape elements 31, the first arc connection elements 431 are disposed at the junctions between the outermost U-shape elements 31 at the two ends of the shelves 3 and the outermost longitudinal elements 32, and upper ends of each of the outermost U-shape elements 31 are located on the inner sides of the arc connection elements. The connection points between the first arc connection elements 431 and the outermost U-shape elements 31 form position-limiting points of the supporting member 4 for the shelf 3, so that the shelf 3 is stably connected to the supporting member 4.

Preferably, second connection elements 432 are provided at the junctions between the connection elements 43 and the extension elements 42. The second connection elements 432 are arc-shaped and have an arc adapted to the contour of the outermost U-shape elements 31. The two ends of the bottom of each of the outermost U-shape elements 31 are disposed on the inner sides of the second connection elements 432. The connection points between the second arc connection elements 432 and the bottoms of the outermost U-shape elements 31 form supporting points of the supporting member 4 for the shelf 3, so that the shelf 3 is stably connected to the supporting member 4.

Preferably, the front frame 1 and the rear frame 2 are each formed by connecting an upper part 11 and a lower part 12. A top end of the lower part 12 is provided with a joining portion 121, and the outer diameter of the joining portion 121 is adapted to the inner diameter of the upper part 11 at a lower end thereof. The joining portion 121 is provided with a pop-out pin 122. The pop-out pin 122 is a telescopic pop-out pin 122. A lower end of the upper part 11 is provided with a positioning hole 111 adapted to the pop-out pin 122. When the upper part 11 is connected to the lower part 12, the joining portion 121 extends into the lower end of the upper part 11, and the pop-out pin 122 is first retracted and then protrudes from the positioning hole 111. The rack, after being disassembled, can have a smaller structure and is easy to store. Moreover, the cooperation of the pop-out pin 122 and the positioning hole 111 can also fulfill the function of positioning, such that after the upper part 11 and the lower part 12 of each of the front frame 1 and the rear frame 2 are assembled together, the supporting members 4 for the upper part 11 and the lower part 12 of each of the front frame 1 and the rear frame 2 are parallel to each other.

The rack easy to assemble and disassemble further comprises at least one hook assembly 5 hooked to the shelf 3. The hook assembly 5 comprises a supporting wire 51, and a number of hooks uniformly distributed on the supporting wire 51. The hooks are divided into first hooks 52 and second hooks 53 arranged at intervals, and the first hooks 52 and the second hooks 53 are both fixed onto the supporting wire 51. A first connecting wire 521, a second connecting wire 522 and a third connecting wire 523 parallel to each other extend rearward from the tail of each of the first hooks 52. The first connecting wire 521 and the third connecting wire 523 are located above the second connecting wire 522, the distance from the first connecting wire 521 and the third connecting wire 523 to the second connecting wire 522 is adapted to the diameter of the longitudinal elements 32, the second connecting wire 522 extends rearward from an end of the first connecting wire 521 and has a length adapted to the distance between two adjacent longitudinal elements 32, and the third connecting wire 523 extends toward the first connecting wire 521 from an end of the second connecting wire 522 and has a length less than the length of the second connecting wire 522. When the hook assembly is connected to a shelf 3, the junction between the first connecting wire 521 and the second connecting wire 522 is placed on the outermost longitudinal element 32 at the bottom of the shelf 3, and the junction between the second connecting wire 522 and the third connecting wire 523 is placed on the longitudinal element 32 adjacent to the outermost longitudinal element 32.

Preferably, a third connection element 524 is provided at the junction between the first connecting wire 521 and the second connecting wire 522, a fourth connection element 525 is provided at a position where the second connecting wire 522 is linked to the third connecting wire 523, and each of the third connection element 524 and the fourth connection element 525 has an arc adapted to the contour of the longitudinal elements 32.

Preferably, sleeves 123 are provided on the same side of the front frame 1 and the rear frame 2. The length of the supporting wire 51 is adapted to the distance between the two sleeves 123. Vertical extensions 511 with axes adapted to the sleeves 123 downwardly extend from two ends of the supporting wire 51. When the hook assembly 5 is connected to the shelf 3, the vertical extensions 511 at the two ends of the supporting wire 51 extend into the sleeves 123. The hook assembly 5 is connected to the shelf 3, the front frame 1 and the rear frame 2 simultaneously, such that the hook assembly 5 can be prevented from shaking during use.

Preferably, the bottom of at least one of the U-shape elements 31 protrudes upwardly to form a blocking edge 311, and the blocking edge 311 has a height greater than that of the horizontal element 41 of the supporting member 4. The blocking edge 311 can prevents goods from falling off from two ends of the shelf 3 when the goods are placed thereon.

The disassembly and assembly principle of the present invention is as follows: when the rack needs to be assembled, foot plugs 61 are first placed into the bottoms of the front frame 1 and the rear frame 2 to connect casters 6 to the rack, the joining portions 121 at the upper ends of the lower parts 12 of the front frame 1 and the rear frame 2 are then connected to the bottoms of the upper parts 11 of the front frame 1 and the rear frame 2, the pop-out pins 122 are pressed such that the joining portions 121 enter the bottoms of the upper parts 11, and the pop-out pins 122 then protrude from the positioning holes 111; the shelf 3 is then placed on two symmetric supporting members 4 of the front frame 1 and the rear frame 2, such that the first arc connection elements 431 of the supporting member 4 are disposed on the junctions between the outermost U-shape elements 31 at two ends of the shelf 3 and the outermost longitudinal elements 32. The upper ends of each of the outermost U-shape elements 31 are located on the inner sides of the arc connection elements, and two ends of the bottom of the outermost U-shape elements 31 are disposed on the inner sides of the second connection elements 432. The first arc connection elements 431 limit the left and right movement of the shelf 3, the second connection elements 432 limit the forward and backward movement of the shelf 3, and the extension elements 42 and the horizontal element 41 limit the up and down movement of the shelf 3, such that the shelf 3 is firmly mounted between the front frame 1 and the rear frame 2. However, when the rack needs to be disassembled, the shelves 3 are first removed from the two symmetric supporting members 4 of the front frame 1 and the rear frame 2, the pop-out pins 122 are then pressed to separate the upper and lower parts of the front frame 1 and the rear frame 2, the foot plugs 61 are taken out of the lower parts 12 to separate the casters 6 from the lower parts 12, and finally the various parts are stacked and stored. If the hook assembly 5 needs to be added, the junction between the first connecting wire 521 and the second connecting wire 522 is placed on the outermost longitudinal element 32 at the bottom of the shelf 3, the junction between the second connecting wire 522 and the third connecting wire 523 is placed on the longitudinal element 32 adjacent to the outermost longitudinal element 32, and the vertical extensions 511 extend into the sleeves 123.

Second Embodiment

Figure 7:
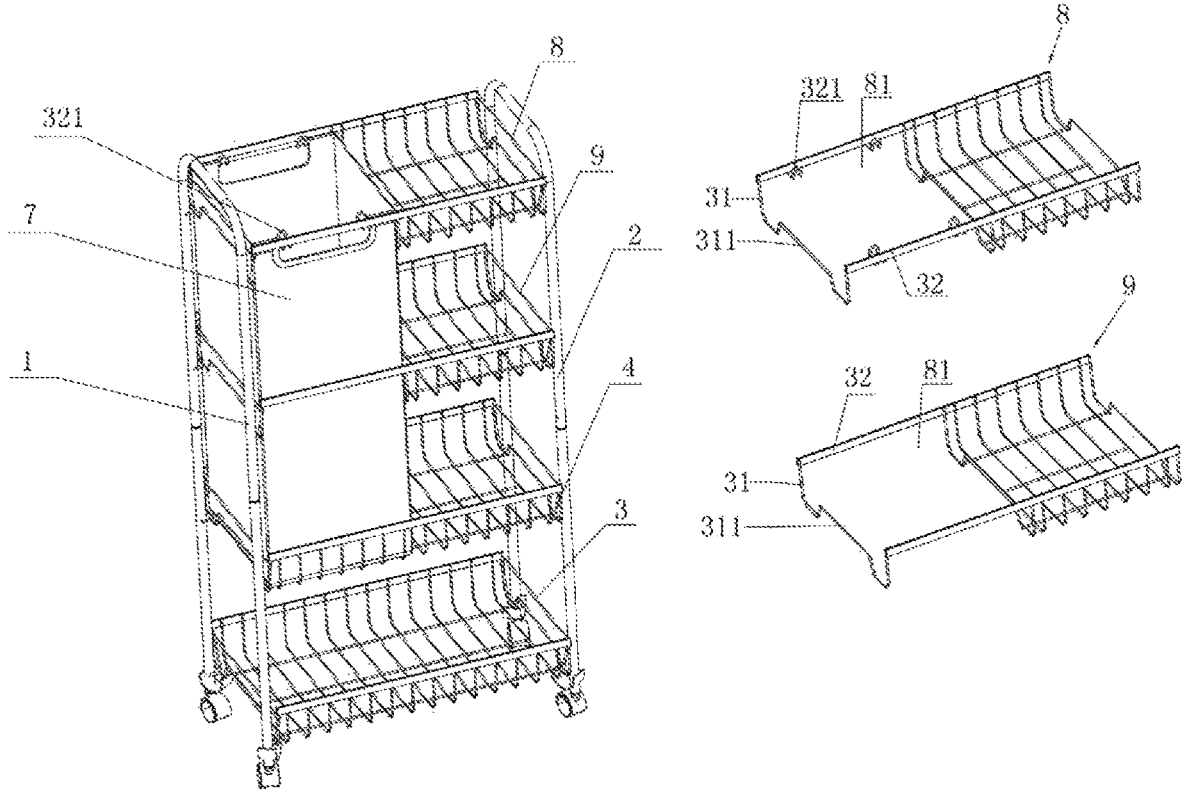
FIG. 7 is a perspective view of a second embodiment of the present invention with one bag.

A second embodiment is further provided in particular embodiments of the present invention. The difference between the second embodiment and the first embodiment is that, as shown in FIG. 7, a bag 7 is further provided in this embodiment. The bag 7 is arranged inside the top shelf 8 and close to the front frame 1 or the rear frame 2, and passes through an intermediate shelf 9 adjacent to the top shelf 8, and both the top shelf 8 and the intermediate shelf 9 are to be changed accordingly while the shelves 3 in other positions have the same structure as that of the shelves 3 in the first embodiment in structure. Particularly, a channel 81 for the bag 7 to pass therethrough is provided inside the top shelf 8, the channel 81 is composed of the longitudinal elements 32 and the U-shape elements 31 with blocking edges 311, and at least two hooks 321 are arranged at intervals on the longitudinal elements 32 on two sides of the channel 81, the hooks 321 being used for hooking the bag 7. The intermediate shelf 9 adjacent to the top shelf 8 is then dispensed with the structure of the hooks 321. The other structures of the intermediate shelf 9 are identical to those of the top shelf 8, except the structure of the hooks 321. By providing the bag 7, a wider variety of articles can be better placed, and the bag 7 is removably connected via the hooks 321, such that when the bag 7 is not needed or when the bag 7 is replaced, the bag can be directly removed or replaced, making the operation easier.

Figure 8:
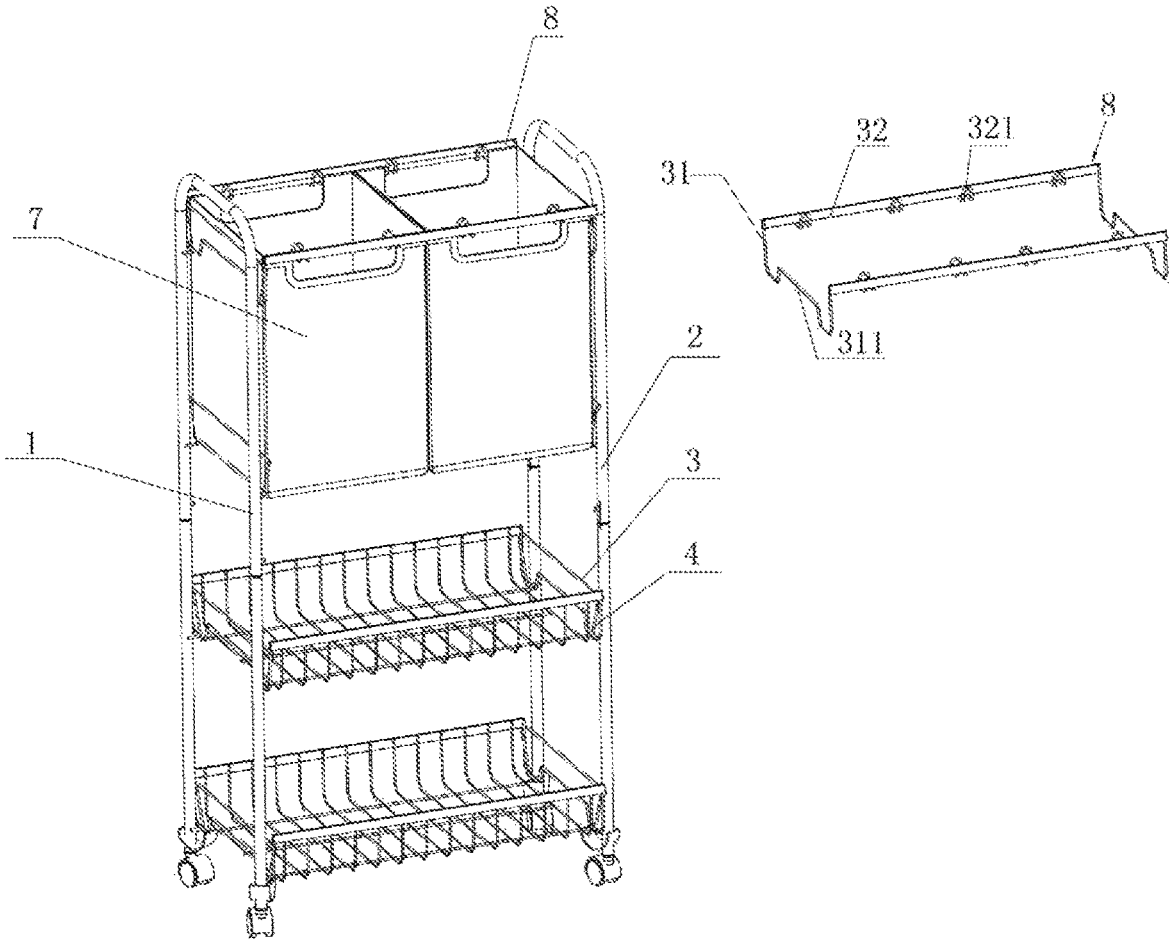
FIG. 8 is a perspective view of a second embodiment of the present invention with two bags.

As shown in FIG. 8, the top shelf 8 in this embodiment can also be additionally provided the bag 7 by dispensing with the U-shape elements 31 in the top shelf 8 and adding the hooks 321. Particularly, in this embodiment, the top shelf 8 is dispensed with the U-shape elements 31 therein, and the U-shape elements 31 with the blocking edges 311 are only arranged at two ends of the top shelf 8. Further, the top shelf 8 is composed of two U-shape elements 31 with blocking edges 311 and two longitudinal elements 32 and forms a rectangular channel, and at least four hooks 321 are arranged at intervals on the longitudinal elements 32, such that two bags 7 can be arranged inside the top shelf 8 at the same time. Particularly, the number of the bags 7 can be flexibly set as required simply by adding the hooks 321. The other structures in this embodiment are identical to those in the first embodiment and the same structures are no longer described again.

Third Embodiment

Figure 9:
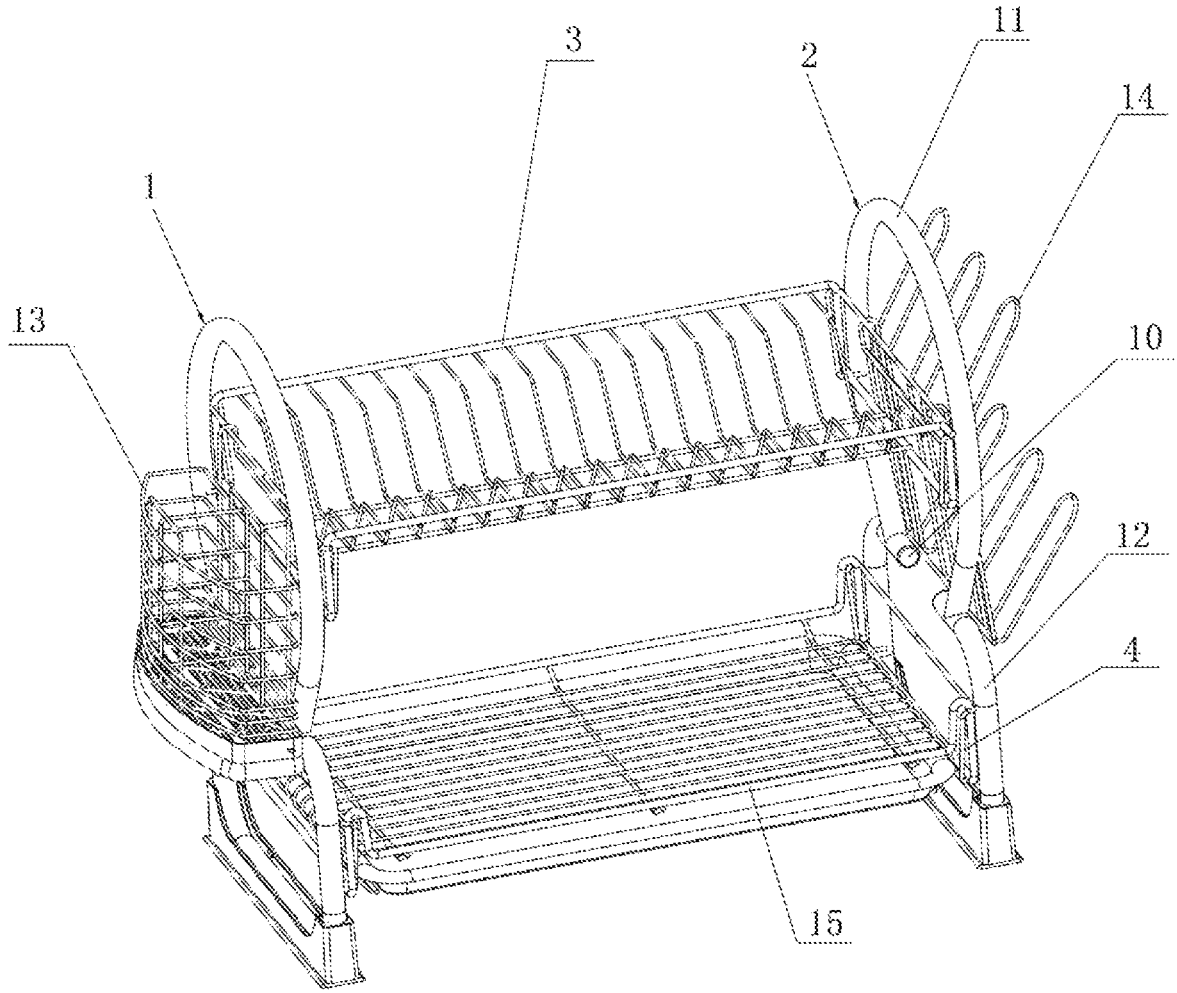
FIG. 9 is a perspective view of a third embodiment of the present invention.

A third embodiment is further provided in the particular embodiments of the present invention. The difference between the third embodiment and the first embodiment is that, as shown in FIG. 9, in this embodiment, both the front frame 1 and the rear frame 2 are dispensed with the joining portion 121, the pop-out pin 122 and the positioning hole 111, the removable connection of the upper parts 11 and the lower parts 12 of the front frame 1 and the rear frame 2 in the first embodiment is changed to the rotary connection of the upper parts 11 and the lower parts 12 of the front frame 1 and the rear frame 2. Particularly, in this embodiment, the upper part 11 forms a circular opening, the lower part 12 forms a rectangular opening, and the opening of the upper part 11 is connected to the opening of the lower part 12 via a rotary connection portion 10. The upper part 11 is rotatable relative to the lower part 12, so that the rack can be easily folded and stored when not in use, and does not occupy too much space after being folded and stored. Further, the bottom of the lower part 12 is further provided with a non-slip mat, the upper part 11 and the lower part 12 are each provided with the supporting members 4, and the shelves 3 are hung on the supporting members 4 between the upper part 11 of each of the front frame 1 and the rear frame 2. The shelves 3 can also be replaced by a dish rack, and a tableware cage 13 and a knife rest 14 are respectively hung on two sides of the front frame 1 and the rear frame 2, and a draining rack 15 is hung on the supporting members 4 between the lower parts of the front frame 1 and the rear frame 2, such that the rack can be used for the kitchen to place dishes, tableware, trays and knives, and the utility is greatly improved. The supporting members 4 and the shelves 3 in this embodiment are identical to those in the first embodiment, and the specific structures thereof are no longer described again.

The above description is only the preferred embodiments of the present invention and is not intended to limit the present invention. Any modifications, equivalent substitutions, improvements, etc. made within the spirit and principles of the present invention should be included in the scope of protection of the present invention.

What is claimed is:

1. A rack easy to assemble and disassemble, comprising a front frame that has a plurality of front legs, a rear frame that has a plurality of rear legs, and a first shelf arranged between the front frame and the rear frame for storing articles thereon, wherein the front frame comprises a first supporting member and the rear frame each comprises a second supporting member, wherein the first supporting member and the second supporting member are parallel to each other and configured to support the first shelf symmetrically between the front frame and the rear frame, the first shelf being hung on the first and second supporting members to connect the front frame to the rear frame;

each of the first and second supporting members comprising:

a horizontal wire element, a pair of extension wire elements, and a pair of connection wire elements;

wherein for the first supporting member on the front frame:

the horizontal wire element is horizontally arranged on a first surface of each of the front legs;

the pair of extension wire elements are arranged on a second surface of each of the front legs that face each other, the pair of extension wire elements being below the horizontal wire element, the pair of connection wire elements extend diagonally between the pair of extension wire elements and the horizontal wire element to connect the pair of extension wire elements to opposite ends of the horizontal wire element;

wherein for the second supporting member on the rear frame:

the horizontal wire element is horizontally arranged on a third surface of each of the rear legs;

the pair of extension wire elements are arranged on a fourth surface of each of the rear legs that face each other, the pair of extension wire elements being below the horizontal wire element, the pair of connection wire elements extend diagonally between the pair of extension wire elements and the horizontal wire element to connect the pair of extension wire elements to opposite ends of the horizontal wire element;

wherein the first surfaces of the front legs and the third surfaces of the rear legs face each other.

2. The rack easy to assemble and disassemble according to claim 1, further comprising at least one second shelf;

wherein the front frame comprises at least one third supporting member and the rear frame comprises at least one fourth supporting member;

wherein the at least one third supporting member is identical to the first supporting member;

wherein the at least one fourth supporting member is identical to the second supporting member;

wherein the at least one third supporting member and the at least one fourth supporting member are configured to support the at least one second shelf symmetrically between the front frame and the rear frame.

3. The rack easy to assemble and disassemble according to claim 2, wherein each shelf comprises a number of transversely arranged U-shape elements and a number of longitudinally arranged longitudinal elements which connects the U-shape elements together.

4. The rack easy to assemble and disassemble according to claim 3, wherein corresponding junctions between the connection wire elements and the horizontal wire element of each supporting member are engaged with respective junctions between corresponding outermost U-shape elements at two ends of each shelf and the corresponding outermost longitudinal elements; and two bottom portions of each of the outermost U-shape elements of each shelf are engaged with corresponding junctions between the connection wire elements and the extension wire elements of a corresponding pair of supporting members.

5. The rack easy to assemble and disassemble according to claim 1, wherein a width of the first shelf is slightly greater than a width of the front frame and a width of the rear frame respectively.

6. The rack easy to assemble and disassemble according to claim 3, wherein a first arc connection element is provided at a corresponding junction between each connection wire element and each horizontal wire element of each support member, wherein corresponding first arc connection elements are disposed at respective junctions between corresponding outermost U-shape elements at two ends of each shelf and corresponding outermost longitudinal elements of each shelf respectively, and upper ends of each of the outermost U-shape elements being located on inner sides of the corresponding first arc connection elements.

7. The rack easy to assemble and disassemble according to claim 6, wherein each first arc connection element is arc-shaped adapted to engage a corresponding outermost U-shape element.

8. The rack easy to assemble and disassemble according to claim 6, wherein second connection elements are provided at corresponding junctions between the connection wire elements and the extension elements of each supporting member, bottom portions of each of the outermost U-shape elements being disposed on inner sides of corresponding second connection elements.

9. The rack easy to assemble and disassemble according to claim 8, wherein the corresponding second connection elements are arc-shaped and adapted to engage the outermost U-shape elements of each shelf respectively.

10. The rack easy to assemble and disassemble according to claim 1, wherein the front frame and the rear frame are each respectively formed by:

an upper part and a lower part being connected, the lower part is provided with a joining portion, an outer diameter of the joining portion is adapted to the inner diameter of the upper part at a lower end thereof, the joining portion is provided with a pop-out pin, the lower end of the upper part is provided with a positioning hole adapted to receive the pop-out pin, and when the upper part is connected to the lower part, the joining portion extends into the lower end of the upper part, and the pop-out pin protrudes from the positioning hole.

11. The rack easy to assemble and disassemble according to claim 1, further comprising a hook assembly hooked to the first shelf, wherein the hook assembly comprises:

a supporting wire, and a number of hooks uniformly distributed on the supporting wire, said hooks comprising first hooks and second hooks arranged at intervals, said first hooks and said second hooks fixed onto the supporting wire; a first connecting wire portion, a second connecting wire portion and a third connecting wire portion extending rearward from the tail of each of the first hooks, wherein for each of the first hooks:

the first connecting wire portion and the third connecting wire portion located above the second connecting wire portion, the second connecting wire extends rearward from an end of the third connecting wire portion and has a length corresponding to a distance between two corresponding adjacent longitudinal elements of the first shelf, the third connecting wire portion extends toward the first connecting wire portion from an end of the second connecting wire portion and has a length less than the length of the second connecting wire portion.

12. The rack easy to assemble and disassemble according to claim 11, wherein for each of the first hooks:

the third connecting wire portion comprises an arc that corresponds to a contour of a corresponding longitudinal element of the first shelf.

13. The rack easy to assemble and disassemble according to claim 11, wherein a sleeve is provided on each of the front frame and the rear frame, wherein the sleeves are parallel to each other, a length of the supporting wire corresponds to a distance between the sleeves, vertical extensions extend downwardly from ends of the supporting wire, wherein the vertical extensions are configured to be inserted in the sleeves to connect the hook assembly to the front frame and the rear frame.

14. The rack easy to assemble and disassemble according to claim 9, wherein a central bottom portion of each of the U-shape elements of each shelf protrudes upwardly to form a blocking edge, the blocking edge having a height greater than that of the longitudinal elements of each shelf respectively.

15. The rack easy to assemble and disassemble according to claim 1, further comprising at least one bag for placing articles therein, the at least one bag being arranged inside the first shelf adjacent to the front frame or the rear frame.

16. The rack easy to assemble and disassemble according to claim 15, wherein the at least one bag is removably connected to the first shelf.

17. The rack easy to assemble and disassemble according to claim 16, wherein a channel for a corresponding bag to pass therethrough is defined within the first shelf, a plurality of hooks being arranged at intervals on two sides of the channel, and the hooks being used for hooking the corresponding bag.

18. The rack easy to assemble and disassemble according to claim 1, wherein the front frame and the rear frame are each respectively configured to be formed by connecting an upper part and a lower part in a rotatable manner, wherein the lower part of the front frame comprises the front legs; wherein the lower part of the rear frame comprises the rear legs.

19. The rack easy to assemble and disassemble according to claim 18, wherein for each of the front frame and the rear frame:

the upper part has a circular opening, the lower part has a rectangular opening, the opening of the upper part is connected to the opening of the lower part via a rotary connection portion such that the upper part is able to rotate relative to the lower part.

20. The rack easy to assemble and disassemble according to claim 19, further comprising a tableware cage for placing tableware therein and a knife rest for placing a knife therein, the tableware cage and the knife rest being respectively hung on one of the front frame and the rear frame.

* * * * *